US008650881B2

(12) United States Patent
Ziminsky et al.

(10) Patent No.: US 8,650,881 B2
(45) Date of Patent: Feb. 18, 2014

(54) METHODS AND APPARATUS FOR COMBUSTOR FUEL CIRCUIT FOR ULTRA LOW CALORIFIC FUELS

(75) Inventors: Willy Steve Ziminsky, Simpsonville, SC (US); Lewis Berkley Davis, Jr., Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 1193 days.

(21) Appl. No.: 12/494,961

(22) Filed: Jun. 30, 2009

(65) Prior Publication Data

US 2010/0326082 A1 Dec. 30, 2010

(51) Int. Cl.
*F02C 1/00* (2006.01)
*F02G 3/00* (2006.01)

(52) U.S. Cl.
USPC ..... 60/746; 60/747; 60/748; 60/742; 60/734

(58) Field of Classification Search
USPC ..... 60/742, 746, 747, 748, 734, 737, 60/39.463, 39.465, 739, 738, 740
See application file for complete search history.

(56) References Cited

U.S. PATENT DOCUMENTS

| | | | | |
|---|---|---|---|---|
| 3,490,870 | A * | 1/1970 | De Land | 423/455 |
| 4,833,878 | A | 5/1989 | Sood et al. | |
| 5,491,970 | A * | 2/1996 | Davis et al. | 60/776 |
| 5,749,219 | A * | 5/1998 | DuBell | 60/804 |
| 5,829,967 | A | 11/1998 | Chyou | |
| 5,895,211 | A * | 4/1999 | McMillan | 431/10 |
| 6,095,791 | A | 8/2000 | Senior | |
| 6,155,820 | A | 12/2000 | Dobbeling et al. | |
| 6,385,960 | B1 * | 5/2002 | Kress et al. | 60/778 |
| 6,532,881 | B2 | 3/2003 | Marin et al. | |
| 6,676,716 | B2 | 1/2004 | Fujimura et al. | |
| 7,966,820 | B2 * | 6/2011 | Romoser | 60/742 |
| 2008/0280239 | A1 | 11/2008 | Carroni et al. | |
| 2009/0031728 | A1 | 2/2009 | Miura et al. | |
| 2009/0113895 | A1 | 5/2009 | Steele et al. | |

* cited by examiner

*Primary Examiner* — William H Rodriguez
(74) *Attorney, Agent, or Firm* — Armstrong Teasdale LLP

(57) ABSTRACT

A method for controlling a gas turbine combustion system includes supplying an ultra low calorific fuel to a combustor of the combustion system through a first fuel circuit, controlling a supply of the ultra low calorific fuel through a second fuel circuit as required to control the volumetric flow of the ultra low calorific fuel through the combustor, and combusting the ultra low calorific fuel in the combustor.

8 Claims, 2 Drawing Sheets

METHODS AND APPARATUS FOR COMBUSTOR FUEL CIRCUIT FOR ULTRA LOW CALORIFIC FUELS

BACKGROUND OF THE INVENTION

The field of the present invention relates generally to the use of ultra low calorific fuels and more particularly to methods and apparatus for using such fuels for energy production.

Ultra low calorific fuels, i.e., fuels having a heating value of about 40 MJ/kg or less, which may include furnace gases, biomass gasification, or fuels with $CH_4$ content less than 10%, $H_2$ content less than 10% and $N_2$ content greater than 40% are typically "opportunity" fuels that are available as a waste stream or as the byproduct of a processing or manufacturing plant. Examples of these fuels are the so-called "blast furnace" gases (BFG) and "coke oven" gases (COG) that are generated from the smelting of iron. Even though such fuels are essentially "free," there is a cost of compression for their use in a gas turbine. The combustion of ultra low calorific fuels in gas turbines generally present a significant design challenge given the large volumetric fuel flow required for a given energy input and the low reactivity of the fuel. To accommodate these fuels, at least some known combustion systems include fuel injectors that are large enough to pass the required site specific fuel volume such that air and fuel velocities are low enough for flame stabilization. Moreover, some known combustion systems rely on fuel blending with a more reactive fuel that enables the combustion of the gas in an existing low to medium calorific fuels combustor.

It would therefore be desirable to provide a combustor or combustion system that can utilize both ultra low calorific fuels and higher energy fuels, as desired, without having to rely on injectors that are designed to pass the entire fuel volume needed for each type of fuel, and to provide a combustion system that does not rely on fuel blending to burn ultra low calorific fuels.

BRIEF DESCRIPTION OF THE INVENTION

In one aspect, some embodiments of the present disclosure provide a method for controlling a gas turbine combustion system. The method includes supplying an ultra low calorific fuel to a combustor of the combustion system through a first fuel circuit, controlling a supply of the ultra low calorific fuel through a second fuel circuit as required to control the volumetric flow of the ultra low calorific fuel through the combustor, and combusting the ultra low calorific fuel in the combustor.

In another aspect, some embodiments of the present disclosure provide a diffusion combustion system. The diffusion combustion system includes a combustor having one or more fuel inlets, an endcover, a combustion casing, and a combustion liner. The combustor is configured to accept an ultra low calorific fuel through a first fuel circuit, control a supply of the ultra low calorific fuel through a second fuel circuit as required to control the volumetric flow of the ultra low calorific fuel through the combustor, and combust the ultra low calorific fuel in the combustor.

DETAILED DESCRIPTION OF THE INVENTION

Embodiments of the present disclosure leverage a quaternary fuel system architecture to facilitate increasing physical fuel flow area available to a designer. For example, this architecture enables the use of a low to medium calorific fuels combustor for a wide range of ultra low calorific fuels, without site specific resizing of the main fuel nozzles by leveraging a combustor casing fuel circuit. The quaternary fuel system architecture allows use of these fuels without fuel blending and without requiring validation of site-specific resized main combustion nozzles. The additional fuel flow area and flexibility provided by the quaternary system enables fuel introduction at the correct pressure ratio despite varying calorific values. Thus, not only is the additional cost of fuel compression reduced, but the injection velocities from the main fuel nozzles are also facilitated to be reduced. The reduction of velocities through the main fuel nozzles facilitates impacting the stability of the diffusion flames that characterize these systems. Additionally, by premixing a portion of the fuel with the air upstream of the main fuel nozzles, flame lengths are also facilitated to be reduced, thus effectively creating a longer residence time for the combustion process.

Figure 1:
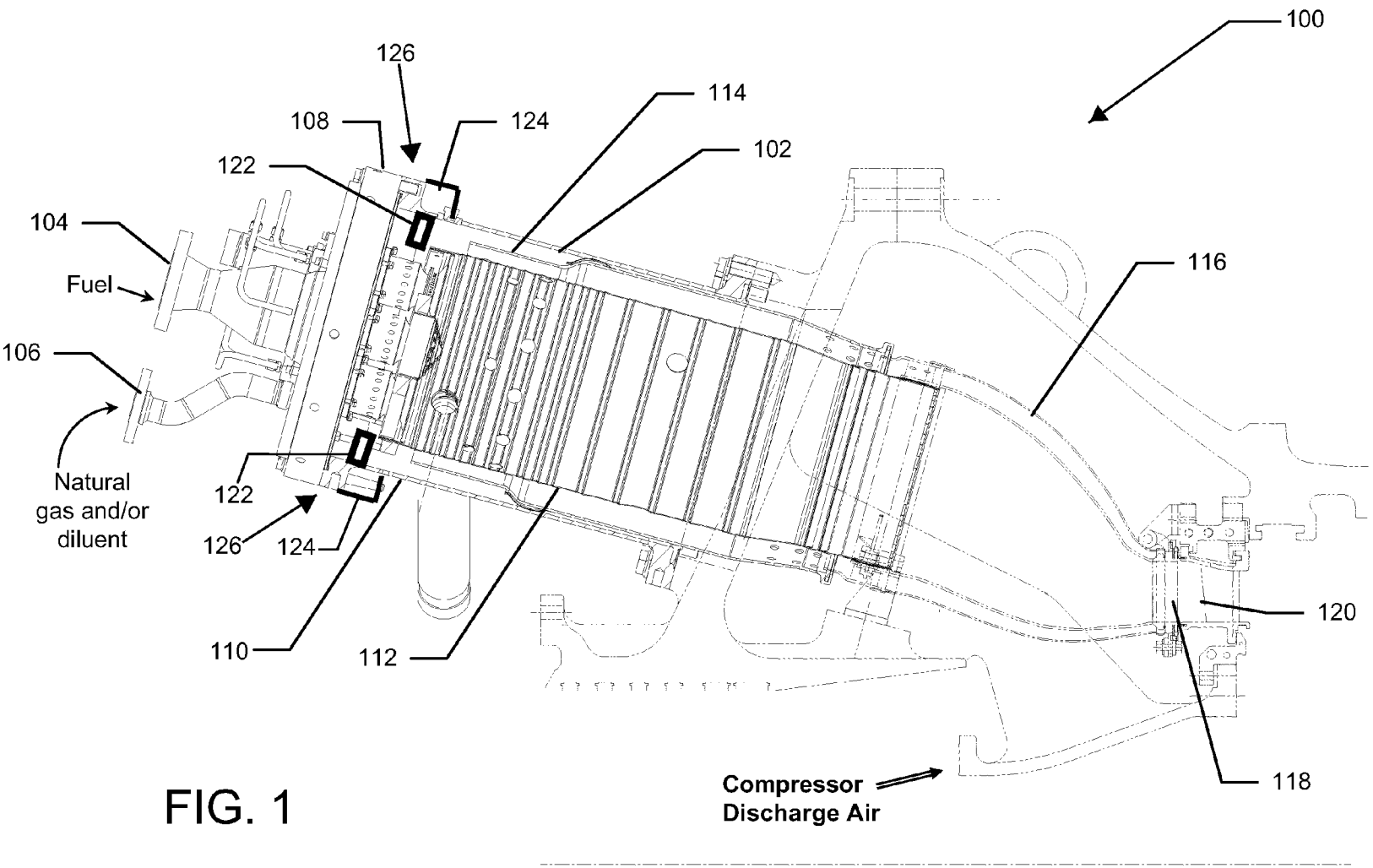
FIG. 1 is a cross sectional view of an exemplary combustor.

More specifically, and referring to FIG. 1, in the exemplary embodiment, an integrated gasification combined cycle (IGCC) combustion system includes a multi-nozzle quiet combustor (MNQC) 102 having one or more fuel inlets 104, a natural gas and/or diluent inlet 106, an endcover 108, a combustion casing 110, and a combustion liner 112. MNQC 102 further includes a flow sleeve 114, a transition piece 116, and a stage one nozzle.

In various embodiments, a plurality of quaternary pegs ("quat pegs") 122 coupled in fluid communication with a quaternary manifold ("quat manifold") 124 are provided near endcover 108. The term "quaternary" has been used in conjunction with GE Power Systems' DLN-2 burner to represent a premixed manifold and pegs through which a fuel or fuel mixture can be injected to facilitate dynamics abatement. In the present disclosure, the term "quaternary" is used to denote an architecture that can facilitate increasing the physical fuel flow area available to a designer, thereby enabling a low to medium calorific fuels combustor to operate with a wide range of ultra low calorific fuels without site specific resizing of the main fuel nozzles. More specifically, an additional fuel circuit including quat pegs 122 and quat manifold 124 upstream of fuel nozzle 118 is provided to introduce the fuel to combustor 102. In some embodiments, fifteen or sixteen quat pegs 122 are spaced circumferentially around combustion casing 110. Alternately, more or less than fifteen pegs 122 can be included in other embodiments. In the exemplary embodiment, quat pegs 122 are part of the injection system of quat manifold 124, although in other embodiments, injectors other than pegs 122 can be used, provided the injectors are configured to introduce the fuels into the flow path of the combustion system.

The injection of fuel through quat pegs 122 or other injectors depends upon a pressure ratio schedule, such that when the effective area in the normal fuel circuit is insufficient for the fuel being used, a control system (not shown in FIG. 1) would direct additional fuel flow through the additional fuel circuit. A very large volumetric fuel flow for a given energy input to the turbine is required for ultra low calorific fuels, which is why the additional fuel circuit is needed to accommodate an additional fuel nozzle area. Thus, various embodiments of the present disclosure use a fuel circuit available on other types of combustion systems for dynamics control and make it available as an additional fuel circuit in a diffusion combustion system to provide an additional fuel flow area.

Figure 2:
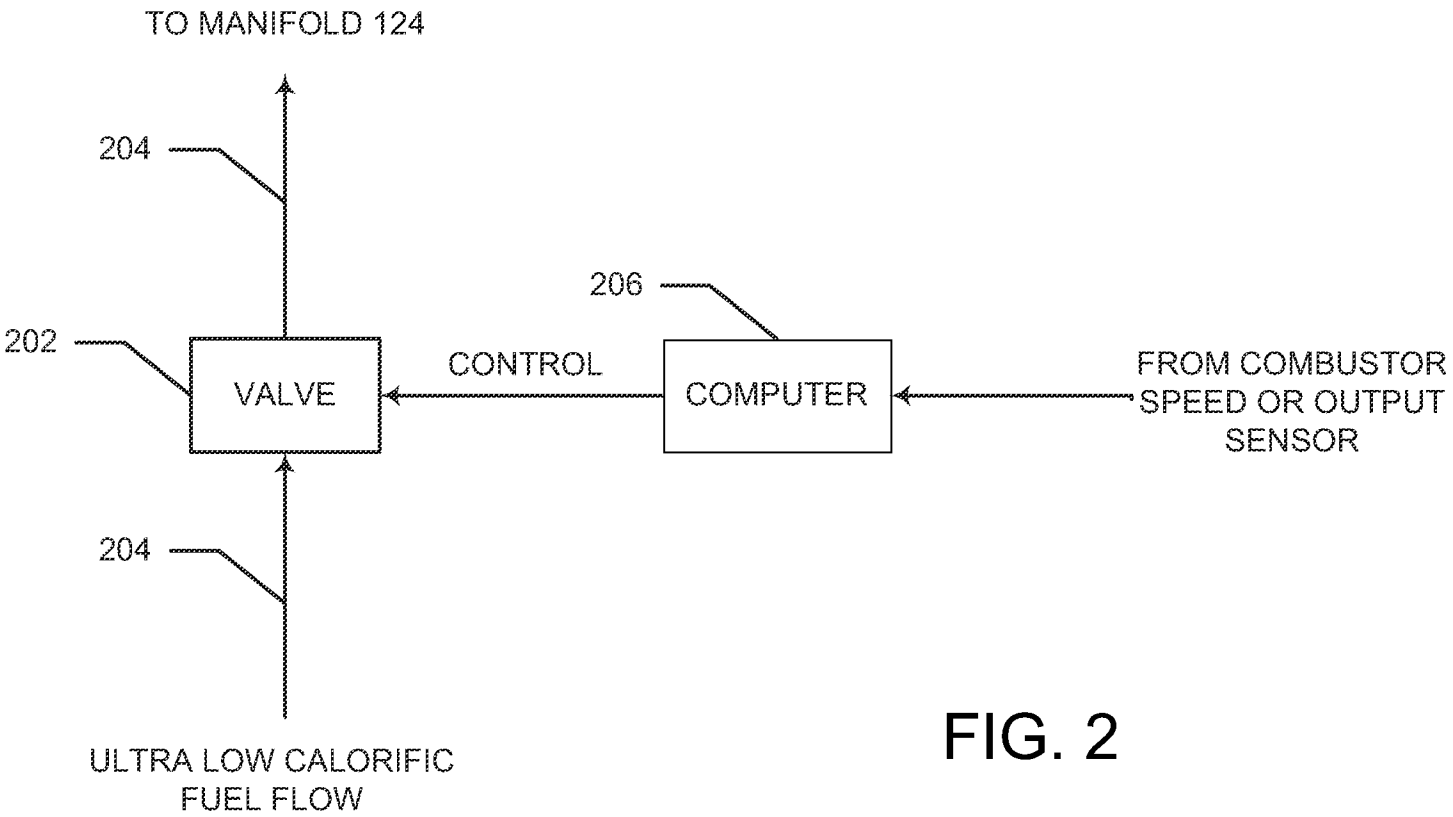
FIG. 2 is a schematic block diagram of an exemplary control circuit that may be used for controlling the combustor of FIG. 1.

Referring now to FIG. 2, some embodiments of the present disclosure include a valve 202 that controls fuel flow 204. Valve 202 is controlled by a suitable electronic device 206, which may be a computer, processor, or controller, for example. (For convenience, "electronic device 206" will hereinafter be referred to, without loss of generality, as "computer 206.") More specifically, MNQC fuel flow 204 is controlled to a target gas turbine output, such that computer 206 functions as a feedback controller, i.e., fuel flow 204 is adjusted to control the output of the gas turbine, subject to pressure limitations.

To summarize, some embodiments of the present disclosure provide a method for controlling an IGCC combustion system 100. The method includes supplying an ultra low calorific fuel to a combustor 102 of the combustion system 100 through a first fuel circuit 104, controlling a supply of the ultra low calorific fuel through a second fuel circuit 126 as required to control the volumetric flow of the ultra low calorific fuel through the combustor 102, and combusting the ultra low calorific fuel in the combustor 102.

In some embodiments, controlling a supply of the ultra low calorific fuel through second fuel circuit 126 includes injecting fuel through a plurality of quat pegs 122 or other injectors to introduce a flow of fuel into a flow path of the combustor 102. Also in some embodiments, controlling a supply of the ultra low calorific fuel through second fuel circuit 126 includes controlling a flow of fuel into a manifold 124 coupled in fluid communication with quat pegs 122. Controlling a flow of fuel into manifold 124 can also include controlling a flow of fuel into a manifold 124 coupled in fluid communication with quat pegs 122. Controlling a flow of fuel into a manifold 124 in fluid communication with quat pegs 122 can also include controlling a flow of the fuel into a manifold 124 coupled in fluid communication with quat pegs 122 spaced circumferentially about a combustion casing 110 of combustor 102. Manifold 124 and quat pegs 122 can also be located proximate to end cover 108 in some embodiments. Also, in some embodiments, controlling a supply of the ultra low calorific fuel through second fuel circuit 126 as required to control the volumetric flow of the ultra low calorific fuel through combustor 102, further includes utilizing a computer 206 to adjust a fuel flow through second fuel circuit 126 to control an output or speed of the gas turbine, subject to pressure limitations.

In another aspect, some embodiments of the present disclosure provide a diffusion combustion system 100. The diffusion combustion system includes a combustor 102 that includes one or more fuel inlets 104, an endcover 108, a combustion casing 110, and a combustion liner 112. Combustor 102 is operable with an ultra low calorific fuel through a first fuel circuit 104, and to control a supply of the ultra low calorific fuel through second fuel circuit 126 as required to control the volumetric flow of the ultra low calorific fuel through combustor 102, and to combust the ultra low calorific fuel in combustor 102.

In some of the system embodiments, to control a supply of the ultra low calorific fuel through second fuel circuit 126, combustor 102 injects fuel through quat pegs 122 to introduce a flow of fuel into a flow path of combustor 102. Also, to control the supply of the ultra low calorific fuel through second fuel circuit 126, combustor 102 controls a flow of fuel into a manifold 124 coupled in fluid communication with quat pegs 122. In yet other embodiments, to control the flow of fuel into a manifold 124 coupled in fluid communication with quat pegs 122, combustor 102 controls the flow of fuel into a manifold 124 coupled in fluid communication with quat pegs 122. In some embodiments, the plurality of quat pegs 122 are spaced circumferentially around combustion casing 110 of combustor 102. Also, some embodiments also include a computer 206 that adjusts a fuel flow through second fuel circuit 126 to control an output or speed of the gas turbine, subject to pressure limitations.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for controlling a gas turbine combustion system, said method comprising:

supplying an ultra low calorific fuel to a combustor of the combustion system through a first fuel circuit that includes a first fuel injector;

controlling a supply of the ultra low calorific fuel through a second fuel circuit as required to control the volumetric flow of the ultra low calorific fuel through the combustor, wherein controlling the supply of the ultra low calorific fuel includes:

injecting fuel through at least a second fuel injector included in the second fuel circuit to introduce a flow of fuel into a flow path; and controlling the flow of fuel into a manifold coupled in fluid communication with the second fuel injector and with a plurality of quat pegs; and combusting the ultra low calorific fuel in the combustor.

2. A method in accordance with claim 1 wherein said controlling a flow of fuel into a manifold coupled in fluid communication with a plurality of quat pegs further comprises controlling a flow of fuel into a manifold coupled in fluid communication with a plurality of quat pegs spaced circumferentially about a combustion casing of the combustor.

3. A method in accordance with claim 1 wherein said controlling a supply of the ultra low calorific fuel through a second fuel circuit as required to control the volumetric flow of the ultra low calorific fuel through the combustor further comprises utilizing a computer to adjust a fuel flow through the second fuel circuit to control an output or speed of the gas turbine, subject to pressure limitations.

4. A method in accordance with claim 3 wherein said controlling a flow of the fuel into a manifold coupled in fluid communication with a plurality of quat pegs further comprises controlling a flow of fuel into a manifold coupled in fluid communication with a plurality of quat pegs spaced circumferentially about a combustion casing of the combustor.

5. A diffusion combustion system comprising a combustor comprising at least one fuel inlet, an endcover, a combustion casing, and a combustion liner, said combustor configured to:

accept an ultra low calorific fuel supplied through a first fuel circuit;

control a supply of the ultra low calorific fuel through a second fuel circuit as required to control the volumetric flow of the ultra low calorific fuel through the combustor;

inject fuel through at least a second fuel injector included within the second fuel circuit to introduce a flow of fuel into a flow path; and control the flow of fuel into a manifold coupled in fluid communication with the second fuel injector and with a plurality of quat pegs; and combust the ultra low calorific fuel in said combustor.

6. A system in accordance with claim 5 wherein said plurality of quat pegs are spaced circumferentially about said combustion casing.

7. A system in accordance with claim 5 further comprising a computer configured to adjust a fuel flow through said second fuel circuit to control an output or speed of a gas turbine, subject to pressure limitations.

8. A system in accordance with claim 7 wherein said quat pegs are spaced circumferentially about a combustion casing of the combustor.

* * * * *